US007576761B2

(12) United States Patent
Suzuki et al.

(10) Patent No.: US 7,576,761 B2
(45) Date of Patent: Aug. 18, 2009

(54) PRINTER

(75) Inventors: Kazutaka Suzuki, Fukushima-ken (JP); Hiroyuki Murayama, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 10 days.

(21) Appl. No.: 12/027,596

(22) Filed: Feb. 7, 2008

(65) Prior Publication Data

US 2008/0186375 A1 Aug. 7, 2008

(30) Foreign Application Priority Data

Feb. 7, 2007 (JP) ..... 2007-027967

(51) Int. Cl.
*B41J 25/316* (2006.01)

(52) U.S. Cl. ..... 347/198; 400/120.17

(58) Field of Classification Search ..... 347/197, 347/198, 172, 173; 400/120.16, 120.17
See application file for complete search history.

(56) References Cited

U.S. PATENT DOCUMENTS 6,549,224 B2 * 4/2003 Connor ..... 347/198
6,616,362 B2 * 9/2003 Bouverie et al. ..... 400/692
7,042,480 B2 * 5/2006 Ito ..... 347/220
7,145,583 B2 * 12/2006 Ito ..... 347/197

FOREIGN PATENT DOCUMENTS

JP 11-254715 A 9/1999

* cited by examiner

*Primary Examiner*—Huan H Tran
(74) *Attorney, Agent, or Firm*—Brinks Hofer Gilson & Lione

(57) ABSTRACT

In a printer of the invention, a plurality of head units each including a line thermal head having heat-generating elements arranged in a direction orthogonal to a conveying direction of a recording paper are arranged in the conveying direction of the recording paper. The head unit has an angle-adjusting mechanism that adjusts the angle between the conveying direction of the recording paper, and the arranging direction of the heat-generating elements, and a position-adjusting mechanism that slidingly moves thermal head in the arranging direction of the heat-generating elements. An angle-adjusting screw of the angle-adjusting mechanism and a position-adjusting screw of the position-adjusting mechanism are disposed at an external surface of the head unit, which is orthogonal to the line thermal head.

6 Claims, 4 Drawing Sheets

PRINTER

This application claims benefit of Japanese Patent Application No. 2007-027967 filed on Feb. 7, 2007, the entire content of which is hereby incorporated by reference.

BACKGROUND

1. Field of the Invention

The present invention relates to a printer, and particularly, to a printer that can be suitably utilized as a thermal printer in which a plurality of recording units are provided with line thermal heads, respectively.

2. Description of the Related Art

Generally, a thermal printer that performs color-printing is provided with a plurality of head units. A line thermal head, in which heat-generating elements are arranged, is attached to each of the head units in a direction (width direction of a recording paper) orthogonal to a conveying direction of the recording paper.

When the plurality of head units are assembled into a printer, in order to improve printing quality, it is necessary to make the arranging direction of the heat-generating elements parallel to the width direction of the recording paper, and to align the position of the heat-generating elements with the width direction of the recording paper. Therefore, in a conventional printer, an angle-adjusting mechanism and a position-adjusting mechanism of thermal head are provided in the head unit, and the angle and position of thermal head is adjusted by an angle-adjusting screw and a position-adjusting screw (refer to JP-A-11-254715).

However, as for adjusting mechanisms of the thermal head, there is a problem in that, since the angle-adjusting screw and the position-adjusting screw may be concealed by the arrangement of the head unit, it is difficult to perform the operation of the angle-adjusting screw and position-adjusting screw. Further, if the type of the angle-adjusting screw and the type of the position-adjusting screw are different from each other, operability gets worse.

Moreover, there is a problem in that, since the operation of the angle-adjusting screw and position-adjusting screw may be operated erroneously after thermal head is adjusted, it is necessary to readjust the thermal head.

Here, if the angle-adjusting mechanism and position-adjusting mechanism are formed with a complicated mechanism, the manufacturing cost of the printer may increase, and the failure rate of the angle-adjusting mechanism and position-adjusting mechanism may also increase.

SUMMARY

A printer includes a plurality of head units arranged in a conveying direction of a recording sheet. Each head unit has a line thermal head having heat-generating elements arranged in a direction orthogonal to the conveying direction of the recording paper. A movable plate is formed so as to extend in an arranging direction of the heat-generating elements in order to fix the line thermal head. A holding plate is formed so as to extend in the arranging direction of the heat-generating elements in order to hold the movable plate so as to be movable in a direction in which the angle between the conveying direction of the recording paper and the arranging direction of the heat-generating elements is changed, and in the arranging direction of the heat-generating elements. An angle-adjusting mechanism changes the angle between the conveying direction of the recording paper, and the arranging direction of the heat-generating elements by rotational movement of the movable plate to which the line thermal head is fixed. A position-adjusting mechanism slidingly moves the movable plate to which the line thermal head is fixed in the arranging direction of the heat-generating elements. The angle-adjusting mechanism and the position-adjusting mechanism are disposed at an external surface of the head unit, which is orthogonal to the line thermal head.

According to the printer of the invention the adjustment of the thermal head that is necessarily performed after assembling of the head unit can be performed easily and instantly. Thus, the assembling efficiency of the printer improves.

DESCRIPTION OF THE EMBODIMENTS

Hereinafter, a printer of the invention will be described by one embodiment with reference to FIGS. 1 to 7.

Figure 1:
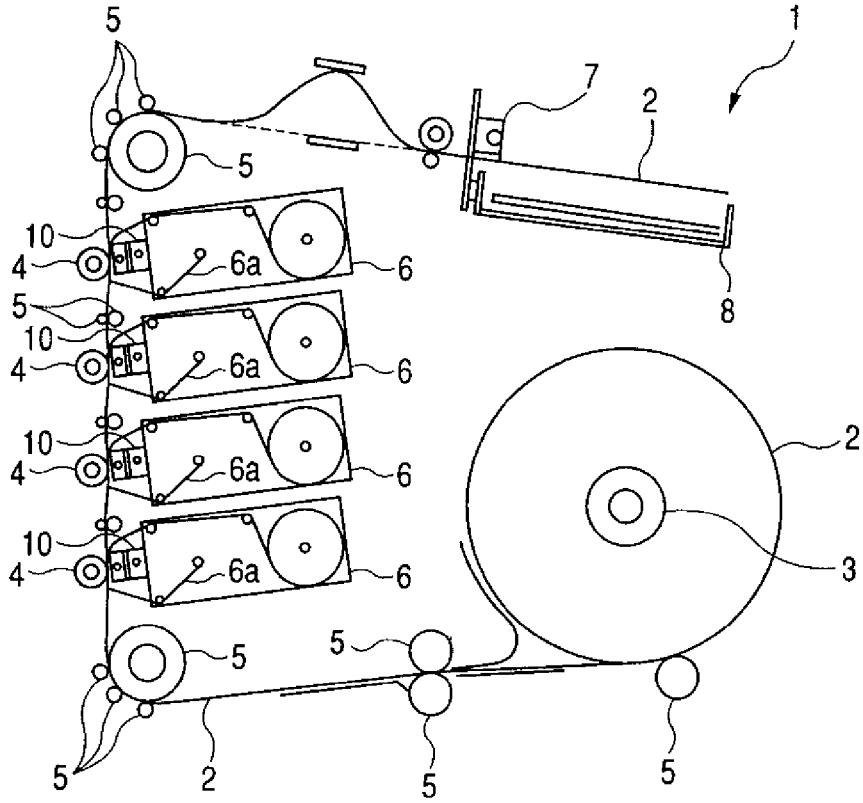
FIG. 1 is a schematic side view showing a printer of this embodiment from the side inside a housing.

FIG. 1 is a schematic side view showing the printer 1 of this embodiment from the side inside a housing. As shown in FIG. 1, the printer 1 of this embodiment includes a recording paper 2, one feed roller 3, four platen rollers 4, a plurality of conveying rollers 5, four recording units 6 each having an ink ribbon 6*a*, and one cutter 7, inside a housing (not shown) having the shape of a substantially rectangular parallelepiped.

The recording paper 2 is a long rolled paper, and is wound around the feed roller 3 connected with a driving motor (not shown). The platen rollers 4 are arranged in a conveying path of the recording paper 2, and the four recording units 6 are disposed in positions that face the four platen rollers 4, respectively, with the recording paper 2 between each recording unit and each platen roller. The conveying rollers 5 that convey the recording paper 2 are suitably disposed on the upstream and downstream sides in the conveying path of the recording paper 2 with respect to the arranged four platen rollers 4. The cutter 7 is disposed around a paper discharge tray 8 formed outside the housing, and is formed so as to cut the recording paper 2 to a predetermined length.

Figure 2:
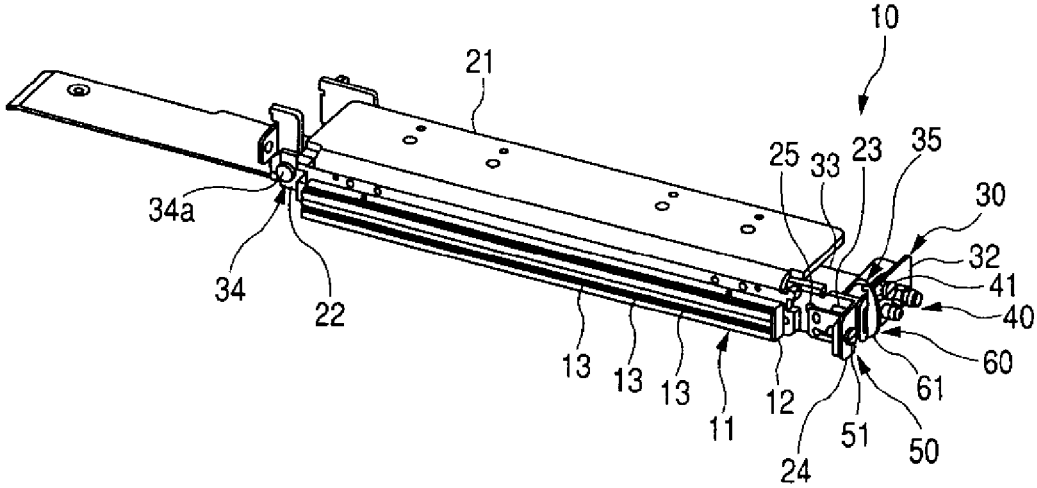
FIG. 2 is a perspective view showing a head unit of this embodiment from the line thermal head side.
Figure 3:
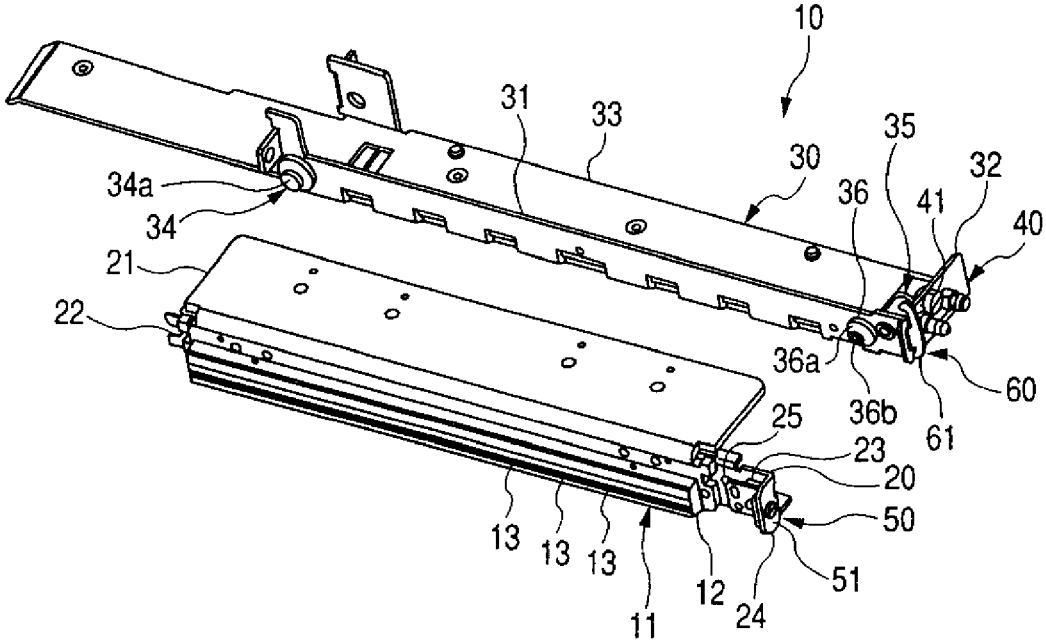
FIG. 3 is an exploded perspective view of FIG. 2.
Figure 4:
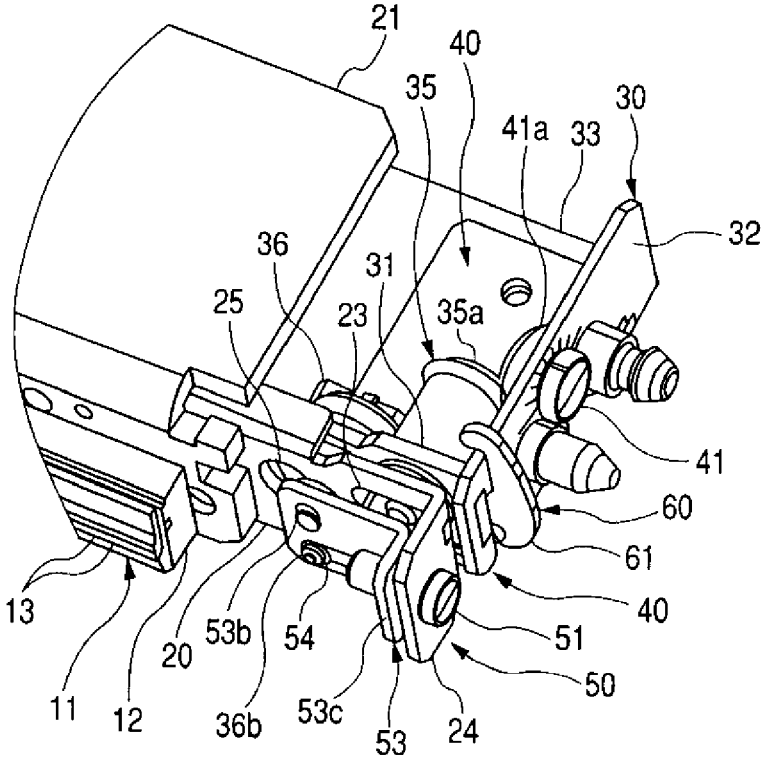
FIG. 4 is a partially enlarged perspective view showing the head unit of this embodiment.
Figure 5:
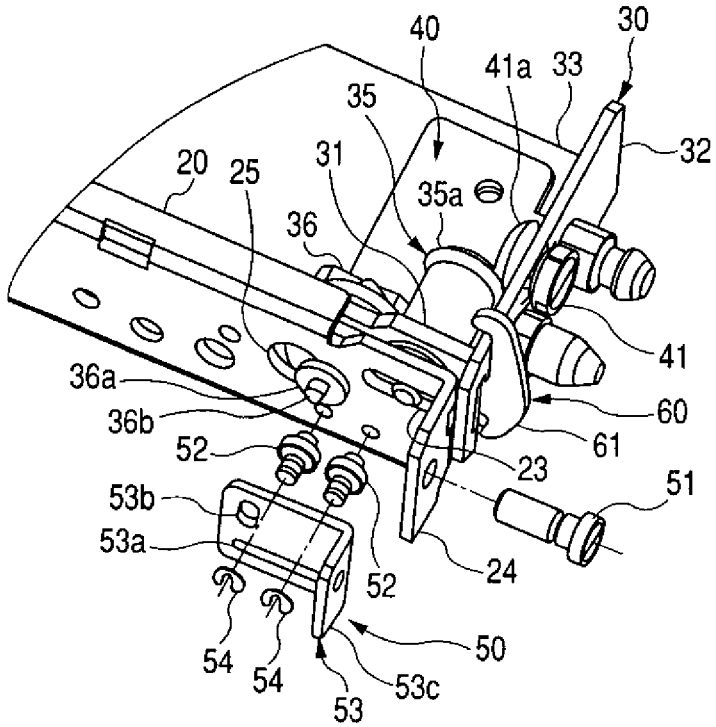
FIG. 5 is an exploded perspective view of FIG. 4.

FIG. 2 is a perspective view showing a head unit 10 of this embodiment from the line thermal head 11 side, and FIG. 3 is an exploded perspective view of FIG. 2. Further, FIG. 4 is a partially enlarged perspective view showing the head unit 10 of this embodiment, and FIG. 5 is an exploded perspective view of FIG. 4. The head unit 10 of this embodiment, as shown in FIG. 1, is disposed in a position that faces the recording paper 2 in each of the four recording units 6. Further, the head unit 10 of this embodiment, as shown in FIGS. 2 and 3, includes a line thermal head 11, a movable plate 20, a holding plate 30, an angle-adjusting mechanism 40, a position-adjusting mechanism 50, and a locking mechanism 60.

As shown in FIGS. 2 and 3, the line thermal head 11 has a head body 12 and heat-generating elements 13 at its foremost part. The head body 12 has a housing having the shape of a substantially rectangular parallelepiped, and a plurality of the heat-generating elements 13 are arranged in a direction (width direction of the recording paper 2) orthogonal to a conveying direction of the recording paper 2 in the surface of the housing that faces the recording paper 2.

The movable plate 20 is a member that bears the line thermal head 11, and is formed in the shape of a substantially rectangular flat plate that extends in the arranging direction of the heat-generating elements 13, and the line thermal head 11 is fixed to the movable plate 20 via an L-shaped protective plate 21. As shown in FIG. 3, a cutout portion 22, a long hole 23, and a large hole 25 are formed in the position of the movable plate 20 apart from the protective plate 21. The cutout portion 22 extends in the arranging direction of the heat-generating elements 13 at one ends (left ends in FIGS. 2 and 3) of the heat-generating elements 13 in their arranging direction. As shown in FIGS. 2 to 5, the long hole 23 extends in the arranging direction of the heat-generating elements 13, similarly to the cutout portion 22, at the other ends (right ends in FIGS. 2 to 5) of the heat-generating elements. The large hole 25 is formed with a larger diameter than the diameter of an auxiliary shaft 36 to be inserted therethrough, around (on the left of the long hole 23 in FIGS. 2 to 5) the long hole 23.

Further, a flat plate-shaped side end 24 that extends in a direction in which the line thermal head 11 is provided is bent and formed at the end of the movable plate 20 in which the long hole 23 is formed. A position-adjusting screw 51 of the position-adjusting mechanism 50 is inserted through the vicinity of the center of the side end 24.

The holding plate 30 is a member that bears the movable plate 20 to which the line thermal head 11 is fixed, and is formed to hold the movable plate 20 so that the movable plate 20 can be moved in a direction in which the angle between the conveying direction of the recording paper 2 and the arranging direction of the heat-generating elements 13 is changed, and in the arranging direction of the heat-generating elements 13. Specifically, as shown in FIG. 3, the holding plate 30 of this embodiment is formed so as to have a holding portion 31 formed in the shape of a rectangle flat plate, a side end 32, and a protective portion 33. The holding portion 31 is formed so as to extend in the arranging direction of the heat-generating elements 13 in a position that faces the movable plate 20.

Further, as shown in FIGS. 3 and 5, a supporting shaft 34 extending in a direction that faces the movable plate 20, the auxiliary shaft 36, and an eccentric shaft 35 are inserted through and supported by the holding portion 31. As shown in FIG. 3, the supporting shaft 34 has an umbrella portion (engaging portion) 34*a* that is larger than the width of the cutout portion 22 on the side of the cutout portion 22, and as shown in FIG. 2, the supporting shaft is inserted through the cutout portion 22 with the umbrella portion 34*a* being engaged with the outside of the cutout portion 22. As shown in FIG. 5, the auxiliary shaft 36 has an umbrella portion (engaging portion) 36*a* that is larger than the width of the large hole 25 on the side of the large hole 25, and the auxiliary shaft is inserted through the large hole 25 with the umbrella portion 36*a* being engaged with the outside of the large hole 25. The eccentric shaft 35 is formed in the shape of a crank, and as shown in FIG. 5, its tip that eccentrically rotates is inserted through the long hole 23. Further, as shown in FIG. 5, the eccentric shaft 35 has a bevel gear 35*a* at its end opposite the direction in which the line thermal head 11 is provided.

Figure 7:
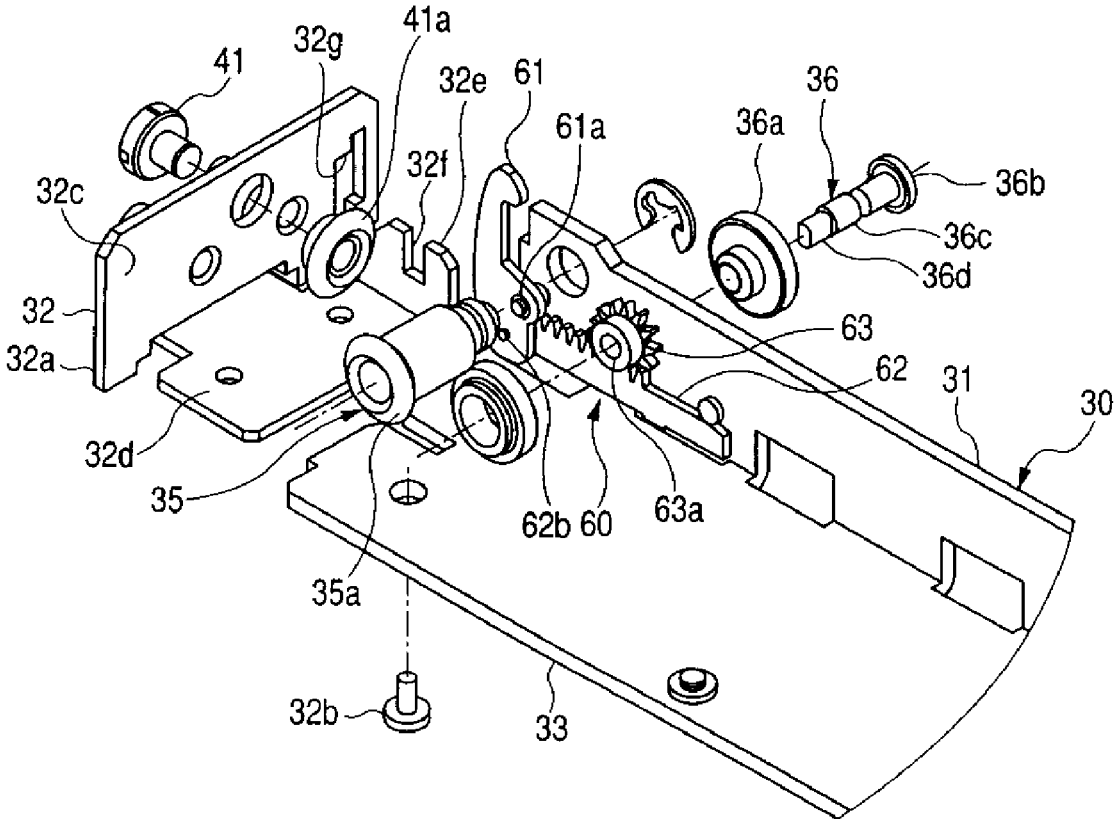
FIG. 7 is an exploded perspective view showing a locking mechanism and its vicinity of this embodiment.

As shown in FIGS. 4 and 7, the protective portion 33 is formed so as to be bent from an end edge of the protective portion 31 of the holding plate 30. The protective portion 33 faces the protective plate 21 when assembled. Further, as shown in FIGS. 4 and 7, an end unit 32*a* that forms the side end 32 of the holding plate 30 is secured to the end of the protective portion 33 where the eccentric shaft 35 is installed, with a screw 32*b*. The end unit 32*a* is formed by bending bent portions 32*d* and 32*e* in order from a flat plate-shaped base portion 32*c* that forms the side end 32. As shown in FIGS. 4 and 5, the side end 32 is disposed so as to extend in a direction opposite to the side end 24 of the movable plate 20 from the end of the holding portion 31 on the side of the eccentric shaft 35. Also, the angle-adjusting screw 41 connected with the eccentric shaft 35 is inserted through the side end 32.

The angle-adjusting mechanism 40 is a mechanism that changes the angle between the conveying direction of the recording paper 2, and the arranging direction of the heat-generating elements 13 with respect to the line thermal head 11, and has an angle-changing mechanism (not shown) that rotationally moves the movable plate 20 slightly to change the angle between the conveying direction of the recording paper 2 and the arranging direction of the heat-generating elements 13, and an angle-adjusting screw 41 that operates the angle-changing mechanism. As shown in FIGS. 2 to 5, the angle-changing mechanism of this embodiment is composed of the supporting shaft 34, the cutout portion 22, the eccentric shaft 35, and the long hole 23. Further, as shown in FIG. 4 and FIG. 5, the angle-adjusting screw 41 is a slotted head screw that has a bevel gear 41*a* on the side of the eccentric shaft 35, and the bevel gear 41*a* is engaged with the bevel gear 35*a* of the eccentric shaft 35.

The position-adjusting mechanism 50 is a mechanism that moves the movable plate 20 in the arranging direction of the heat-generating elements 13, and has a position-changing mechanism (not shown) that slidingly moves the movable plate 20 to which the line thermal head 11 is fixed in the arranging direction of the heat-generating elements 13, and the position-adjusting screw 51 that operates the position-changing mechanism. As shown in FIGS. 2 and 5, the position-changing mechanism of this embodiment is composed of an auxiliary plate 53 and posts 52, in addition to the aforementioned supporting shaft 34, cutout portion 22, auxiliary shaft 36, large hole 25, eccentric shaft 35, and the long hole 23.

As shown in FIG. 5, the auxiliary plate 53 is formed in the shape of an L-shaped plate, and is disposed in accordance with the L-shape of the movable plate 20 in the vicinity of the side end 24 of the movable plate 20. A portion 53*d* of the auxiliary plate 53 facing the movable plate 20 has a long hole 53*a* for posts that extends in the arranging direction of the heat-generating elements 13, and an auxiliary long hole 53*b* that extends in a direction orthogonal to the arranging direction of the heat-generating elements 13.

As shown in FIG. 5, the two posts 52 are formed in a cylindrical shape. One end of each of the posts 52 is fixed around the long hole 23 of the movable plate 20. A male thread is formed at the other end of the post 52, and the external thread is inserted through the long hole 53*a* for posts of the auxiliary plate 53, and is screwed to a butterfly nut 54. The fastening degree of the butterfly nut 54 is adjusted so that the auxiliary plate 53 can be slidingly moved in the arranging direction of the heat-generating elements 13.

As shown in FIG. 5, the auxiliary shaft 36 that is engaged with the large hole 25 has an engaging pin 36*b* that extends further outward from the center of the umbrella portion 36*a*. As shown in FIG. 4, the engaging pin 36*b* is inserted through the auxiliary long hole 53*b* of the auxiliary plate 53.

Further, the position-adjusting screw 51 is inserted from the facing portion 53*d* of the auxiliary plate 53 through the side end 53*c* that is formed so as to be bent perpendicularly to the direction in which the line thermal head 11 is provided so that it can be rotated the arranging direction of the heat-generating elements 13, and is attached so as not to move axially without rotational operation of the position-adjusting screw 51. Also, the threaded portion of the position-adjusting screw is screwed to the side end 24 of the movable plate 20. A slotted head screw is selected as the position-adjusting screw 51 of this embodiment. Here, as shown in FIGS. 4 and 5, the auxiliary plate 53 is engaged with the engaging pin 36*b* of the auxiliary shaft 36 inserted through the holding plate 30. Therefore, the movable plate 20 is moved in the arranging direction of the heat-generating elements 13 by fastening or loosening operation of the position-adjusting screw 51.

Figure 6:
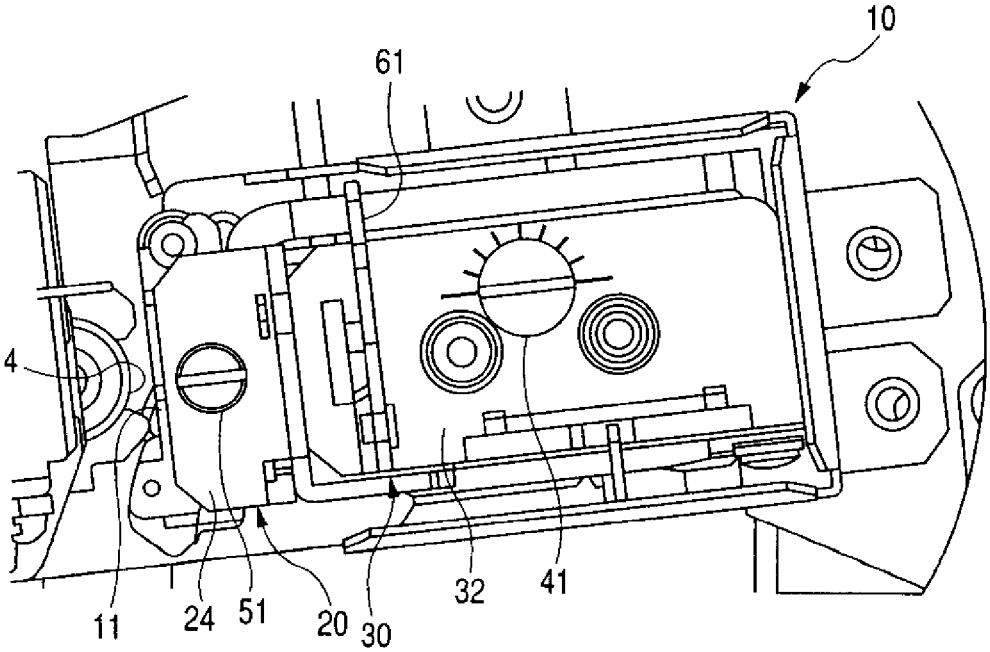
FIG. 6 is a side view showing the head unit of this embodiment from the side.

FIG. 6 shows a side view of the head unit 10. As shown in FIG. 6, the angle-adjusting screw 41 and the position-adjusting screw 51 are disposed at the side end 24 of the movable plate 20 and the side end 32 of the holding plate 30, i.e., at the side surface of the head unit 10. The side surface of the head unit 10 becomes an external surface that faces an adjusting person who that operates the angle-adjusting screw 41 and the position-adjusting screw 51, when the housing of the printer 1 is opened.

FIG. 7 is an exploded perspective view showing a locking mechanism and its vicinity. As shown in FIGS. 5 and 7, the locking mechanism 60 is composed of a locking lever 61, a rack 62, a tap 63, and the auxiliary shaft 36. The locking lever 61 is rotatably attached to the inside of the holding portion 31 with a rotary pin 61*a*, and is connected with the rack 62, which is similarly provided inside the holding portion 31 to extend in the arranging direction of the heat-generating elements 13, with a connecting pin 62*b*. The rack 62 meshes with the tap 63 having a pinion, and the tap 63 attached to the auxiliary shaft 36 is rotated by the rotational operation of the locking lever 61. A female threaded portion 63*a* formed inside the tap 63 meshes with a male threaded portion 36*c* formed on the way of the auxiliary shaft 36. A rectangular shank 36*d* of an inside end of the auxiliary shaft 36 is engaged with a detent groove 32*f* formed at the bent portion 32*e* of the end unit 32*a* so that it can be moved axially to stop the auxiliary shaft 36 from rotating. When the locking lever 61, which is exposed to the outside through a cutout portion 32*g* formed at the side end 32, is rotated and thereby fastened or loosened, the auxiliary shaft 36 moves axially, and the auxiliary shaft 36 holds and fastens the movable plate 20 and the holding plate 30 by the umbrella portion 36*a* and the tap 63 so as to make the movable plate 20 immovable or movable. In other words, the angle-changing mechanism of the angle-adjusting mechanism 40 and the position-changing mechanism of the position-adjusting mechanism 50 will be put into an immovable or immovable state by the operation of the locking lever 61.

Next, the operation of the printer 1 of this embodiment will be described with reference to FIGS. 1 to 7.

In the printer 1 of this embodiment, as shown in FIG. 1, the recording paper 2, the one feed roller 3, the four platen rollers 4, the plurality of conveying rollers 5, the four recording units 6, and the one cutter 7 are assembled into the housing of the printer 1. After the assembling process of the printer 1 is completed, the angle adjustment and position adjustment of the line thermal head 11 that is attached to each recording unit 6 are performed. At this time, as shown in FIG. 6, the angle-adjusting screw 41 and the position-adjusting screw 51 are disposed at the side end 24 of the movable plate 20 and the side end 32 of the holding plate 30, i.e., at the external surface of the head unit 10, which is orthogonal to the line thermal head. Therefore, the adjusting person of the line thermal head 11 can easily operate the angle-adjusting screw 41 and the position-adjusting screw 51, and consequently, can easily and instantly adjust the line thermal head 11.

Further, as shown in FIG. 6, the angle-adjusting screw 41 and the position-adjusting screw 51 are all slotted head screws. Therefore, since the angle-adjusting screw 41 and the position-adjusting screw 51 can be operated only by a minus driver, the operation of the angle-adjusting screw 41 and position-adjusting screw 51 can be performed without changing an adjusting tool, and the adjustment efficiency of the line thermal head 11 improves.

When the angle-adjusting screw 41 is operated as shown in FIG. 4, the eccentric shaft 35 that is engaged with the angle-adjusting screw 41 rotates, and the movable plate 20 moves in the direction orthogonal to the arranging direction of the heat-generating elements 13. Here, as shown in FIG. 2, the supporting shaft 34 is inserted through the cutout portion 22 formed in the arranging direction of the heat-generating elements 13 at one end of the movable plate 20, the movable plate 20 rotates about the supporting shaft 34. As such, in this embodiment, the angle of the line thermal head 11 can be adjusted by a simple angle-adjusting mechanism.

In addition, as shown in FIGS. 3 and 4, the cutout portion 22 and the long hole 23 of the movable part extend in the arranging direction of the heat-generating elements 13. Thus, it is possible to prevent the supporting shaft 34 and the eccentric shaft 35 from limiting the sliding movement of the movable plate 20 in the arranging direction of the heat-generating elements 13.

Further, as shown in FIGS. 2 and 5, the supporting shaft 34 and the auxiliary shaft 36 that are passed through the holding plate 30 hold the movable plate 20, using their umbrella portions 34*a* and 36*a*, and the supporting shaft 34 and the eccentric shaft 35 that are passed through the holding plate 30 are inserted through the cutout portion 22 and the long hole 23 that are formed so as to extend in the arranging direction of the heat-generating elements 13. Also, the engaging pin 36*b* extending from the tip of the auxiliary shaft 36 is engaged with the auxiliary long hole 53*b* of the auxiliary plate 53 that extends in the direction orthogonal to the arranging direction of the heat-generating elements 13. Therefore, when the position-adjusting screw 51 is operated as shown in FIG. 4, the movable plate 20 slidingly moves in the arranging direction of the heat-generating elements 13 on the basis of the auxiliary plate 53 that is engaged with the holding plate 30 via the auxiliary shaft 36. As such, since the movable plate 20 can be slidingly moved by changing the positional relationship between the auxiliary plate 53 that is engaged with the holding plate 30 and the movable plate 20, the position of the line thermal head 11 can be adjusted by a simple position-changing mechanism.

In particular, in this embodiment, the supporting shaft 34 and the auxiliary shaft 36, as shown in FIGS. 2 and 5, are engaged with both ends of the movable plate 20. Thus, it is possible to stably hold and slidingly move the movable plate 22. Further, as shown in FIG. 5, the large hole 25 that allows the auxiliary shaft 36 to be inserted therethrough has a larger diameter than the diameter of the auxiliary shaft 36. Thus, the auxiliary shaft 36 is prevented from contacting the large hole 25 to limit the rotational movement and sliding movement of the movable plate 20.

Also, when the adjustment of the head unit 10 is completed by the operation of the angle-adjusting screw 41 and position-adjusting screw 51, all the four recording units 6 can perform printing in a predetermined position of the recording paper 2. Thus, the printer 1 can perform recording on the recording paper 2 with desired printing quality. However, if the angle-adjusting screw 41 or position-adjusting screw 51 is erroneously operated or the position of the line thermal head 11 is shifted by an external force, printing quality will deteriorate.

Consequently, the head unit 10 of this embodiment has the locking mechanism 60 that makes the angle-changing mechanism of the angle-adjusting mechanism 40 and the position-changing mechanism of the position-adjusting mechanism 50 immovable. As shown in FIG. 5 and FIG. 7, when the locking lever 61 of the locking mechanism 60 is rotationally operated to put the locking lever 61 into an erected state, the auxiliary shaft 36 moves axially via the rack 62 and the tap 63 to fasten the movable plate 20 to the holding plate 30. Therefore, since the line thermal head 11 can be prevented from erroneously moving after the adjustment of the line thermal head 11, readjustment of the line thermal head 11 becomes unnecessary. When the locking lever 61 is tilted, the lever is unlocked to allow the angle adjustment and position adjustment of the line thermal head 11.

That is, according to the printer 1 of this embodiment, the adjustment of the line thermal head 11 that is necessarily performed after assembling of the head unit 10 can be performed easily and instantly. Thus, the assembling efficiency of the printer 1 improves.

In addition, the invention is not limited to the aforementioned embodiment or the like, and various changes thereof can be made if necessary.

For example, the cutout portion 22 of the movable plate 20 of this embodiment is adopted in order to facilitate and improve attachment. However, the long hole 23 extending in the arranging direction of the heat-generating elements 13 instead of the cutout portion 22 may be adopted in other embodiments.

Further, the supporting shaft 34, the auxiliary shaft 36, and the eccentric shaft 35 are used in this embodiment. However, only the supporting shaft 34 and the eccentric shaft 35 may be used in other embodiments. At this time, it is preferable to form an engaging portions, such as an umbrella portion (not shown), not only in the supporting shaft 34 but in the eccentric shaft 35, and to hold a movable part.

The invention claimed is:

1. A printer comprising a plurality of head units arranged in a conveying direction of a recording sheet, each head unit having:

a line thermal head having heat-generating elements arranged in a direction orthogonal to the conveying direction of the recording paper;

a movable plate that is formed so as to extend in an arranging direction of the heat-generating elements in order to fix the line thermal head;

a holding plate that is formed so as to extend in the arranging direction of the heat-generating elements in order to hold the movable plate so as to be movable in a direction in which the angle between the conveying direction of the recording paper and the arranging direction of the heat-generating elements is changed, and in the arranging direction of the heat-generating elements;

an angle-adjusting mechanism that changes the angle between the conveying direction of the recording paper, and the arranging direction of the heat-generating elements by rotational movement of the movable plate to which the line thermal head is fixed, and a position-adjusting mechanism that slidingly moves the movable plate to which the line thermal head is fixed in the arranging direction of the heat-generating elements, wherein the angle-adjusting mechanism and the position-adjusting mechanism are disposed at an external surface of the head unit, which is orthogonal to the line thermal head.

2. The printer according to claim 1, wherein the angle-adjusting mechanism includes and angle-changing mechanism and the position-adjusting mechanism includes a position-changing mechanism and wherein the head unit includes a locking mechanism that makes the angle-changing mechanism, and the position-changing mechanism immovable.

3. The printer according to claim 1, wherein the angle-adjusting mechanism has an angle-adjusting screw, the position-adjusting mechanism has a position-adjusting screw, and the angle-adjusting mechanism and the position-adjusting mechanism are formed in a shape operated by the same adjusting tool.

4. The printer according to claim 1, wherein the movable plate has a cutout portion and a long hole, which extend in the arranging direction of the heat-generating elements, at both ends of the heat-generating elements in their arranging direction, respectively, the holding plate has an eccentric shaft connected with the angle-adjusting screw and an engaging portion having a supporting shaft, at both ends of the heat-generating elements in their arranging direction, respectively, the supporting shaft is inserted through the cutout portion or long hole formed at one end of the movable plate, while its engaging portion is engaged, the eccentric shaft is inserted through the cutout portion or long hole formed at the other end of the movable plate, and the angle-adjusting screw moves the movable plate in the direction in which the angle between the conveying direction of the recording paper and the arranging direction of the heat-generating elements is changed about the supporting shaft, by rotating the angle-adjusting screw to rotate the connected eccentric shaft.

5. The printer according to claim 4, wherein the position-adjusting screw is screwed to an auxiliary plate, which is fixed to or engaged with the movable plate and the holding plate, in the arranging direction of the heat-generating elements, and the movable plate is moved in the arranging direction of the heat-generating elements by the rotation of the position-adjusting screw.

6. The printer according to claim 4, wherein the holding plate has an auxiliary shaft having an engaging portion around the eccentric shaft, the movable plate has a large hole having a larger diameter than the diameter of the auxiliary shaft in a position that faces the auxiliary shaft, and the auxiliary shaft is inserted through the large hole while its engaging portion is engaged.

* * * * *